United States Patent [19]

Dunning et al.

[11] 4,166,001

[45] Aug. 28, 1979

[54] MULTIPLE LAYER FORMATION PROCESS FOR CREPED TISSUE

[75] Inventors: Charles E. Dunning; William D. Lloyd; Joseph G. Bicho, all of Neenah, Wis.

[73] Assignee: Kimberly-Clark Corporation, Neenah, Wis.

[21] Appl. No.: 767,614

[22] Filed: Feb. 10, 1977

Related U.S. Application Data

[63] Continuation-in-part of Ser. No. 481,532, Jun. 21, 1974, abandoned.

[51] Int. Cl.[2] ..... D21H 5/24

[52] U.S. Cl. ..... 162/111; 162/112; 162/113; 162/127; 162/129; 162/183; 162/207; 428/153; 428/154; 428/219

[58] Field of Search ..... 162/101, 111, 112, 113, 162/123, 125, 129, 134, 135, 184, 188, 207, 280, 281, 290, 344, 132, 298, 183; 156/183, 205, 209; 264/121, 282, 283; 428/153, 154, 219

[56] References Cited

U.S. PATENT DOCUMENTS

| | | | |
|---|---|---|---|
| 3,879,257 | 4/1975 | Gentile et al. | 162/112 |
| 3,903,342 | 9/1975 | Roberts | 162/112 |

FOREIGN PATENT DOCUMENTS 1117731 6/1968 United Kingdom .

*Primary Examiner*—Richard V. Fisher
*Assistant Examiner*—Peter Chin
*Attorney, Agent, or Firm*—Leydig, Voit, Osann, Mayer & Holt, Ltd.

[57] ABSTRACT

A process for directly forming multiple layer web, and creping such webs to provide absorbent, soft and bulky, creped tissue. The process produces a laminar fibrous formation with outer layers of strongly bonded fibers separated by an intermediate central section of weakly bonded fibers, which outer layers are creped such that the crepe in one outer layer is independent of the crepe in the other outer layer. The process utilizes a multiple slice inlet with different fiber stock supplied via the inlet to form the weakly bonded central layer of the fibrous formation; the base formation is subjected to two creping operations: one side of the fibrous formation is adhered to the surface of a dryer and creped therefrom, the once-creped web is inverted, and the other side adhered to the surface of a dryer and again creped therefrom, producing finely creped, soft and bulky outer surface layers of strongly bonded fibers which are capable of delamination, each layer shearing away from the other during the creping operations because of the weakly bonded intermediate fibrous section and the final product simulating a two ply tissue in bulk and softness while having been formed as a single ply.

11 Claims, 8 Drawing Figures

MULTIPLE LAYER FORMATION PROCESS FOR CREPED TISSUE

This is a continuation in part of Dunning, Lloyd and Bicho application Ser. No. 481,532 filed June 21, 1974 abandoned, entitled "Creped Laminar Tissue and Process of Manufacture".

Absorbent paper products made predominantly from short cellulosic fibers derived from wood pulp, and of the type used as sanitary tissue products such as facial and bathroom tissues, household and industrial towels and wipes, at the present time are manufactured, in large scale commercial production, by wet laying processes for forming fibers into a fibrous web from an aqueous slurry or stock containing the fibers, as by flowing onto the Fourdrinier wire of the usual Fourdrinier-type web forming machine, a layer of stock and subsequently eliminating sufficient of the water to produce a web capable of being couched off the end of the wire.

In conventional machines, the web is pressed to eliminate water and press the fibers into an essentially two-dimensional, closely contacting formation which enables the development of strong interfiber hydrogen bonds upon final drying of the web. It has also been customary to crepe the web from a Yankee dryer or otherwise longitudinally compress the web to disrupt the bonds and increase the effective thickness of the web, thus providing softness and bulk in the finished product. It is well known, however, that as web thickness increases, it becomes increasingly more difficult to disrupt the web sufficiently to produce a soft, bulky product. In general, with a given set of creping conditions, the heavier the basis weight of the web the coarser the crepe that will result. In conventional creping operations, a creping blade is held against the outer surface of the dryer. As the adhered web reaches the creping blade, the edge of which forms a pocket with the dryer surface, the blade causes the web to buckle, disrupting interfiber bonds and reforming the web into a structure characterized by the typical crepe folds. The reformation from a flat to a creped structure increases the apparent bulk of the web while the disruption of the interfiber bonds tends to open the internal structure of the web, decreases the stiffness of the web and softens the surface. The crepe frequency depends on a number of factors such as the degree of adhesion to the dryer, the thickness of the web and its bending modulus. Generally, it has been found that with thinner webs it is possible to obtain a finer crepe, with proportionally greater enhancement of bulk and softness. High quality tissue as conventionally manufactured, therefore, employs two plies of finely creped lighter basis weight and initially thin webs to achieve the desired bulk and softness.

There are well recognized cost of manufacture savings to be realized if high quality tissue can be made in the form of single ply heavy basis weight webs, since the output from a tissue machine making heavy basis weight single ply tissue will be doubled as compared with that same machine running at the same speed and producing a lower basis weight tissue which ultimately forms one ply of a two ply product. Even if production speeds of heavy basis weight webs do not fully reach the extremely high (on the order of five thousand f.p.m.) machine speeds attained in recent years on some types of tissue machines, the economic advantages are still very favorable, and the attraction of these favorable economics has spurred the industry to develop processes suitable for commercial production of single ply heavy basis weight tissue.

Tissue having bulk, softness and strength adequate for facial tissue and bathroom tissue use has been produced on a limited commercial scale in the form of a single ply product of heavy (10–20 lbs.) basis weight. In a number of known processes, rather than processing a single ply compacted web to increase its bulk, as by creping, the web is formed as a thick, uncompacted fiber formation with minimum natural bonding, as by adding chemical debonders to the stock or by using unbeaten stock, and the initial fiber formation is pattern bonded (using either pressure or adhesive) to achieve strength in a manner that minimizes compaction, and the web may be creped to further increase its effective thickness, as disclosed, for example, in the following patents and published patent applications: Sanford et al. U.S. Pat. Nos. 3,301,746, Salvucci et al. 3,812,000, Gentile et al. 3,879,257, South African application No. 71/8357 dated Dec. 14, 1971.

In these processes, as disclosed in the above patents, pattern bonding and creping achieves web strength by overbonding in the lines or bands of the pattern, while leaving the fibers in the open creped areas of the pattern underbonded with loose fiber ends on the surface and arched, peaked portions which contribute to the subjective quality of softness (at least on one surface) of conventional two-ply creped tissues. These are inherently two sided materials in that the side of the material that was against the dryer during creping has a different configuration than the opposite, outer side. Moreover, the concentrated adhesive and compacted fibers in the overbonded lines or bands of the pattern result in hard and stiff lines or bands of fibers which detract from overall softness and are not totally masked by the peaks and arches of the creped in-between areas.

This invention is based on a different concept of bonding to achieve the desired strength and softness in tissue formed as a heavy basis weight single ply fibrous formation; namely, bonding the layer of fibers adjacent the surface of the formation uniformly overall with stronger interfiber bonds than in the central section of the formation to provide a laminar formation, and a different mode of creping to achieve the desired bulk and softness; namely, creping the laminar web such that it tends to shear in the center and partially delaminate, causing the center section of the web to open and each surface layer of fibers to form a fine crepe. With overall (i.e. a distribution of interfiber bonds in the outer surface layers which bond distribution is substantially equal in every unit area thereof) rather than pattern bonding in the outer surface layers to provide a laminar structure, and creping of the laminar web such that the more strongly bonded outer surface layers of fibers are independently reformed and disrupted so as to produce a fine crepe on both surfaces of the web, a strong, bulky and soft tissue may be made at lower cost.

Accordingly, the primary object of the invention is to provide a creped tissue formed as a single ply and superior in tactile properties and bulk to conventional creped single ply tissue at comparable basis weights.

An important object is to provide a process for producing creped tissue which will enable increases in tissue machine productivity and lower cost of production of a superior tissue product.

A further object is to provide a heavy basis weight creped tissue formed as a single ply and finely creped on both surfaces, and having superior tactile properties making it suitable for use as high quality facial tissue, bathroom tissue and other tissue products.

Another object is to provide a laminar web in which the outer surface layers of fibers have stronger interfiber bonds than the central section of fibers intermediate the outer layers, enabling the production by successive creping operations of a creped tissue product, the crepe in each outer layer being independent in both frequency and phase of the crepe in the other outer layer.

A further object is to provide a heavy basis weight web formed as a single ply and having discrete, creped outer layers of fibers in which the fibers are more strongly bonded than in the central section of the web, interfiber bonds throughout said outer layers being water or solvent resistant, and thus making the web product suitable for use as high quality toweling and wet wipes.

Another object is to provide a process for producing a soft, bulky and absorbent creped tissue by forming a laminar base web with well bonded fiber on the outer surfaces and weakly bonded fiber in the center, said base web being formed as a single ply, and creping the laminar web such that it tends to shear in the center, providing a finished product that is partially delaminated in the center and simulates a two-ply finished product from a sheet that was formed as a single ply.

Another object is to provide a tissue product having superior tactile properties, but incorporating in part lower cost fibers, to reduce the cost of the product.

More specifically, it is an object to provide a tissue having superior tactile properties, but producible using lower cost, lower grade fiber, by forming the tissue with a laminar construction having higher grade, soft, flexible fibers on the surfaces to provide desired superior tactile properties, and having lower grade, coarse fibers intermediate the surfaces, so that the total fiber content is about the same as a comparable basis weight two ply tissue material, but the total fiber cost is less.

Another and important object of the invention is to provide a superior tissue product made with a significant proportion of lower cost, lower grade coarse fiber, by utilizing a laminar web construction as initially formed embodying such lower grade fiber confined within the central or intermediate section of the web, and also to utilize a property of such fibers; namely, that such coarse and stiff fibers have little affinity for each other, to achieve in such a laminar construction, a weakly bonded central section intermediate strongly bonded surface layers, so that upon creping the web from each side, the weakly bonded intermediate section allows the surface layers to shear away from each other and independently crepe during the creping operations to obtain finely creped layers on both surfaces of the web.

Other objects and advantages of the present invention will be apparent as the following description proceeds, taken in conjunction with the accompanying drawings in which.

THE LAMINAR TISSUE PRODUCT (FIG. 7)

Figure 7:
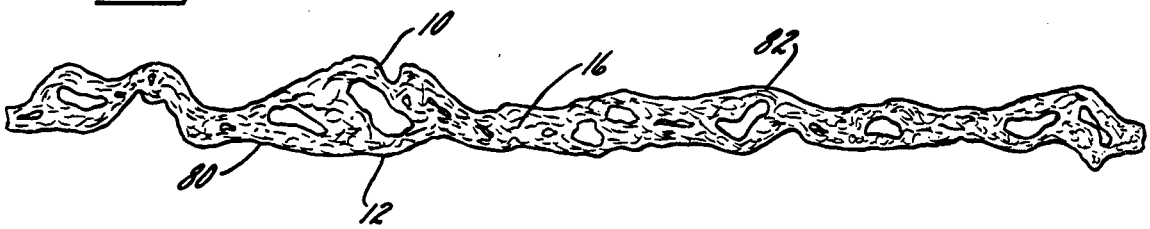
FIG. 7 is a drawing, highly idealized, illustrating in cross section, tissue with a basis weight comparable to the material of FIG. 6A but having a laminar construction in accordance with this invention.

Turning now to the drawings, a soft, bulky and absorbent creped tissue constructed in accordance with the invention is illustrated highly idealized in FIG. 7. In this illustration of the invention, the product is laminar, having surface layers 10, 12 of fibers bonded uniformly overall with stronger interfiber bonds than in the central section 16 of the formation and the product has been creped such that each surface layer has a fine crepe that is independent of the crepe in the other surface layer.

THE PROCESS

In keeping with the process aspects of this invention such a product may be produced by forming a laminar fibrous formation as a single ply, and creping the formation such that each strongly bonded surface layer 10, 12 tends to shear away from the other side of the fibrous formation because of the weakly bonded fibers joining the surface layer to the base of the formation, so as to produce a fine crepe 18 in both surface layers. The invention thus provides a strong, bulky tissue with superior tactile properties, and, in effect, simulates a two-ply finished product from a web formed as a single ply.

While this process may be employed to produce single ply lower basis weight tissue product (about 5–10 lb./2880 sq. ft., dryer basis weight - DBW), it is especially suited for the production of single ply higher basis weight product up to about 40 lb. DBW, and preferably between about 10 and about 30 lb. DBW.

Figure 1:
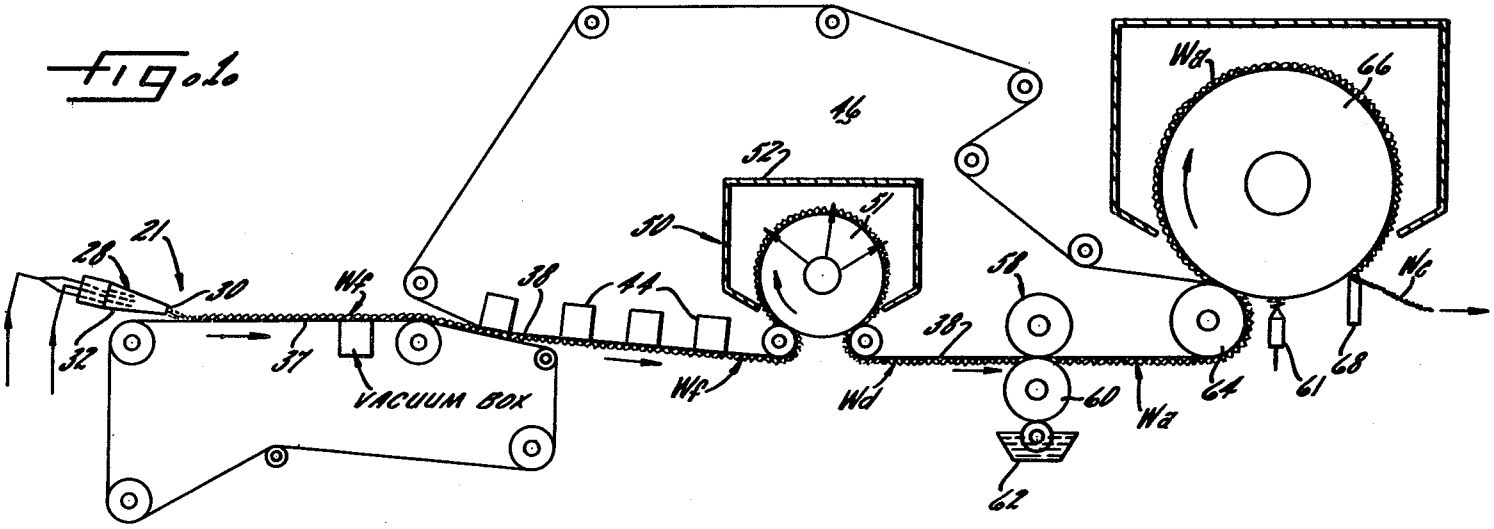
FIG. 1 is a fragmentary schematic illustration of a tissue machine having forming, drying and creping sections for carrying out process steps for the manufacture of tissue in accordance with the invention.
Figure 4:
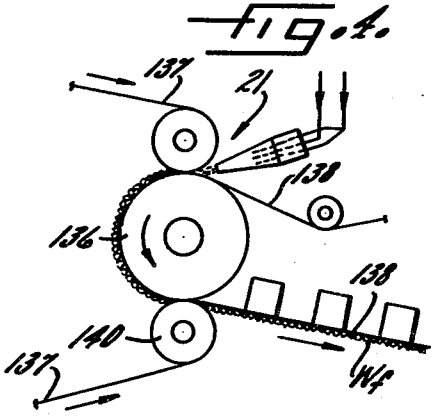
FIG. 4 is a fragmentary schematic illustration of a slice roll forming section for a tissue machine with a multiple stock inlet.
Figure 2:
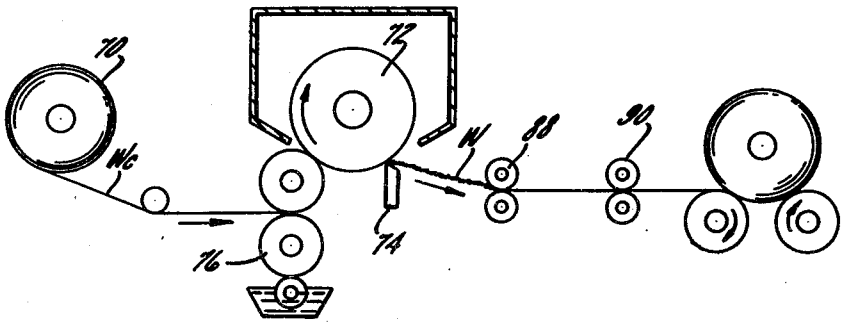
FIG. 2 is a fragmentary schematic illustration of a machine having creping and calendering sections, for carrying out further process steps for the manufacture of tissue in accordance with the invention.
Figure 3:
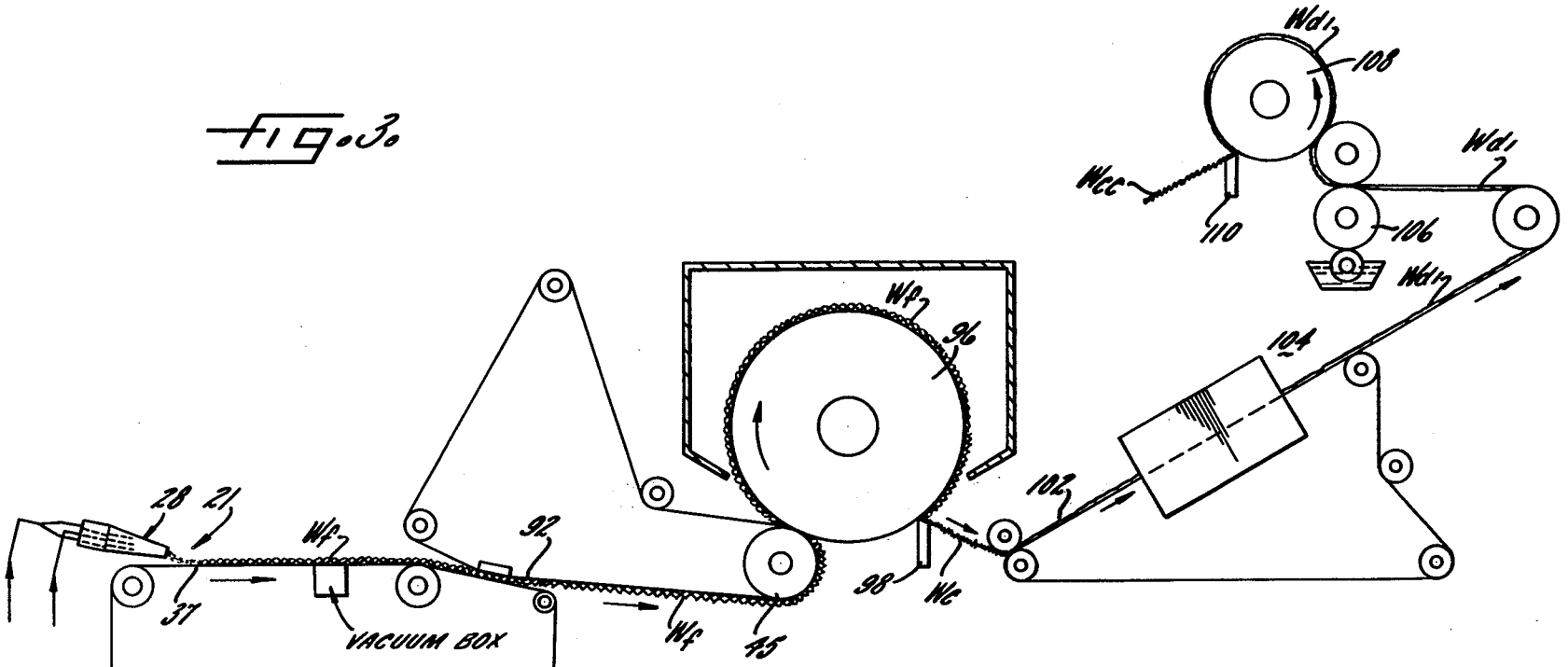
FIG. 3 is a fragmentary schematic illustration of an alternative form of tissue machine having forming, creping, drying and second creping sections for carrying out process steps for the manufacture of tissue in accordance with the invention.

The desired laminar bonding characteristic of the fibrous formation is achieved, in accordance with the present invention, by simultaneously flowing different fiber stock in multiple layers into a forming zone, using for example well refined (i.e., well beaten) and water soaked fibers which have natural affinity for each other for the layers on the outer surfaces, and unrefined fibers (or fibers treated with a debonder) which have little affinity for each other for the central section or layer of the web. With minimum compaction of such a fibrous formation, strong interfiber bonds can be made to form naturally between such well refined fibers in the surface layers, while the unrefined or chemical debonder treated fibers of the central section will be weakly bonded. A multiple inlet 20 for supplying different fiber stock for the direct formation of a laminar fibrous web is illustrated in FIG. 5, and this type of multiple inlet is suitable for tissue machines forming sections 20 as illustrated in FIG. 1, 3 or 4.

It is known that in the manufacture of paper webs, particularly those webs conventionally termed tissue and used for sanitary paper products, interfiber bonding may be reduced by forming and partially drying the fibrous web before subjecting the web to mechanical pressure of a type that compacts the web and bring the fibers into closely contacting engagement with one another, as stated in Salvucci et al. U.S. Pat. No. 3,812,000. Said patent refers to processes and products involving printing bonding material in a pattern onto a previously formed web which has a reduced amount of natural interfiber bonding, and creping such webs differentially to soften the bonded web portions. As noted therein, such webs are characterized by a lack of uniform interfiber bonding throughout the webs, and to overcome this problem said patent also describes adding an elastomeric bonding material to the aqueous slurry from which the webs are formed to uniformly distribute the adhesive at interfiber bonding points throughout the webs. As disclosed therein such elastomeric adhesive bonded fiber webs may be pattern bonded and adhered to the surface of a dryer so as to be differentially creped therefrom.

Figure 5:
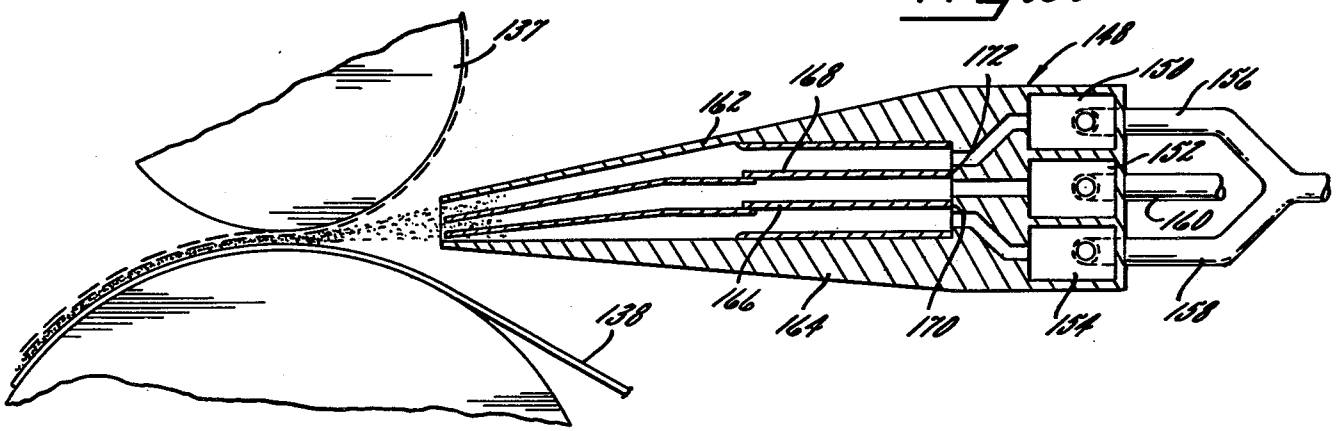
FIG. 5 is a fragmentary schematic illustration on an enlarged scale of a multiple stock inlet for forming sections as shown in FIG. 1, 3 or 4.

In keeping with this invention, heavy basis weight tissue having the laminar strength characteristic herein sought after, (as contrasted with the uniform interfiber bonding throughout as referred to in said patent) may be directly formed from different fiber stock or furnishes with a multiple stock inlet of the type shown in FIG. 5, with the fiber stock supplied to the inlet for the surface layers of the formation having elastomeric adhesive included in the stock to achieve strong, inter-fiber bonds in the surface layers. In this instance the stock supplied for the central layer will have no such adhesive and will have been chemically treated as with debonder or the fibers in the stock will have been mechanically treated so as to reduce their affinity for one another as by using refined stock, to achieve weak interfiber bonds in the central intermediate section of the formation.

MACHINES FOR CARRYING OUT THE PROCESS (FIGS. 1-5)

FIGS. 1-5 illustrate machines for carrying out the requisite process steps to produce absorbent tissue of laminar construction in accordance with this invention. It should be noted at the outset that the initial fibrous web from which the finished product of the invention may be made can be formed on any one of various types of paper making machines. Thus, machines of the type illustrated in FIGS. 1 and 3 are Fourdrinier type machines while FIGS. 4 and 5 illustrate a forming section 20 of the slice roll type disclosed in Loynd U.S. Pat. No. 3,378,435. These machines form the webs from an aqueous suspension of fibers. Tissue machines having other types of forming sections are capable of forming the initial fibrous web from an aqueous stock or furnish or other source of wood fiber. The process aspects of the present invention are believed particularly important from a commercial standpoint, however, since the process is suited to be carried out on tissue machines with high speed forming sections, as for example forming sections as shown in FIGS. 4 and 5. However, the process is equally well suited for more conventional Fourdrinier type machines as shown in FIGS. 1 and 3 wherein, in the forming section 21 the stock inlet 28 directs the stock slurry or furnish through the slot defined by the parallel converging plates 30, 32 of the inlet and onto a forming wire 37.

Commercial tissue machines typically then carry the fibrous web between the wire and a fabric through one or more press sections to extract water from the web, and then to the surface of a Yankee dryer from which the web is creped wet or dry depending on the water content in the web as it arrives at the creping blade. Such machines are supplied conventionally with well refined stock and after dewatering and compacting in the press sections, the web produced on such commercial machines is compact and characterized by closely engaged well bonded fibers, the bonds being of the type called hydrate or hydrogen bonds in the papermaking art. A single-ply, thin, fine creped web is illustrated highly idealized in FIG. 6, with the fine crepe in such a web appearing essentially as relatively sharp peaks 42 with valleys 44 in-between and having a fairly regular frequency, the peaks on one surface being reflected by valleys on the opposite surface and the frequency and phase of the crepe on both surfaces of the web thus being the same.

DIRECT FORMING OF LAMINAR PRODUCT (FIGS. 4, 5)

According to the invention, the desired laminar bonding construction in a web may be produced by directly forming the web from different fiber stock as by means herein shown as a multiple stock inlet for a water laying tissue machine, as illustrated in FIG. 5. This type of multiple inlet is suitable for flowing layers of different stock onto the wire of a Fourdrinier-type machines as in FIGS. 1 and 3, and also is suitable for higher speed forming sections of tissue machines as illustrated, for example, in FIG. 4.

Referring to FIG. 4, one of the rolls, which may be termed a forming roll 136, also carries a top fabric 138 that is disposed between the wire 137 and the peripheral surface of the roll 136 and the arrangement is such that the stock is discharged to form the web between the wire and the fabric on the forming roll 136. The wire and fabric move in the direction of the arrow downwardly around the forming roll 136 and the stock travels around the forming roll as a sandwich between the wire and fabric, being dewatered during this travel. Centrifugal force also helps in this dewatering action, since the forming roll is rapidly rotating as the wire passes around it, and centifugal force is effective for throwing water from the web, which passes outwardly through the interstices of the wire. The forming wire 137 leaves the surface of the forming roll 136 and passes to the lower support roll 140 for the wire as it leaves the fibrous web. The felt 138 leaves the forming roll and passes in a generally horizontal direction to the dryer sections of the machines, the formed web Wf separating from the wire and following the felt, being carried on the lower surface of the felt 138.

Now turning to FIG. 5, the multiple inlet shown can be utilized to supply three layers of stock simultaneously onto a forming wire 37 in a machine as shown in FIG. 1 or 3, or into the gap between a forming wire and fabric of a machine forming section of the type shown in FIG. 4, thus enabling the direct formation of a fibrous web having surface layers of different fibers, or differently chemically or mechanically treated fibers, as compared with the central layer of fibers of the web. To this end (FIG. 5) the inlet 148 has separate supply chambers 150, 152, 154 each connected as by supply piping to separate stock sources. In this case the outer supply chambers 150, 154 are connected to a common stock source by pipe sections 156, 158, and the central supply chamber 152 is connected to a different stock source by another pipe section 160. The outer supply chambers 150, 154 feed stock under pressure through a nozzle formed by outer converging fixed plates 162, 164, and within the nozzle the streams of stock are maintained separated by flexible separators 166, 168 extending into the nozzle outlet, and held at their back end 170, 172 while being free to float. Stock is carried under pressure through the pipe sections 156, 158, 160 to the supply compartments 150, 152, 154 of the stock inlet 148, and the pressure of the stock, as it feeds through the nozzle holds the floating separators 166, 168 equidistant apart.

With such a multiple inlet 148, the desired laminar formation may be produced by choice of fiber, as by directly forming the web with soft, pliable, flexible, well beaten and water soaked fibers from highly refined stock supplied to the outer supply compartments 150, 154 of the inlet. The intermediate section of the fiber formation may be formed from fibers of unrefined stock. With minimum compaction of the formation, as with a tissue machine of the type shown in FIG. 1 where dewatering is carried out with minimum compaction of the web, and the web is dried by through drying with minimum compaction, strong interfiber bonds will form naturally between such well beaten and water soaked fibers in the surface layers of the formation, while the unbeaten and unrefined fibers of the central section preferably chemically treated with debonder have little affinity for each other and will be weakly bonded. When such a laminar formation is creped from the creping drum 66 in FIG. 1, for example, with the addition of adhesive by the printing roll 60 in quantity sufficient to obtain adhesion to the creping drum for crepe control, the surface layer of fibers can be caused to finely crepe by the creping blade 68, the layer of fibers adhered to the creping drum surface tending to shear away from the outer side of the sheet during the creping operation. The web Wc after adhesive application for crepe control and creping on the off line printer of FIG. 2, having been inverted between the creping operations, will be creped on both sides having separate, discrete, strongly bonded fiber layers on both surfaces separated by the weakly bonded fibers of the web as initially formed.

With a multiple inlet as illustrated in FIG. 5, elastomeric adhesive may be added to the stock supplied to the outer supply compartments 130, 134 of the multiple inlet 128 so as to produce adhesive interfiber bonds in the outer layers of the web formation upon subsequent drying, to augment natural interfiber bonds of the hydrogen or hydrate type produced by using highly refined stock. Less costly, low grade stock may be supplied to the center compartment 152, the fibers of which being coarse or having high lignin content typically form weak interfiber bonds as desired here but which is normally undesirable in the manufacture of paper products. In short, by choice of fiber, or by choice of mechanical and chemical treatment of stock supplied to such a multiple inlet 148, a laminar fibrous formation may be directly formed having stronger interfiber bonds in the surface layers of fibers than in the intermediate section of fibers therebetween. Upon surface creping as by means of the machines of FIGS. 1 and 2, or the machine of FIG. 3, a tissue product having soft, bulky outer layers with crepe independent in frequency and phase may be produced.

Furthermore, in a machine like that shown in FIG. 3 where the web is unavoidably subjected to some degree of pressure in the act of transfer between the felt and the Yankee dryer, in order to increase production speeds it may be necessary or desirable to raise the pressure in the nip between the felt and the Yankee dryer from a light pressure (<200 pli) toward the level of higher pressures (400–500 pli) typical of present day commercial machines of this type. When the web is compacted in such a higher pressure nip the fibers will be consolidated into a thinner, more dense structure. With a web having a laminar fibrous formation as formed, because the middle layer of fibers are weakly bonded, when such a web even though consolidated is creped from the Yankee dryer, the disruptive action of the creping blade will be effective to open the fiber formation and recover its bulk such that the web will be thick and unconsolidated. By subsequent creping, preferably through successive steps of dry creping one surface and then the other, a tissue product having independent, fine crepe in both surface layers may be produced.

EXAMPLES OF THE LAMINAR TISSUE PRODUCT AND CONVENTIONAL TISSUE

To aid in understanding how laminar, creped tissue products constructed according to this invention compare in bulk, surface characteristics and internal structure with tissue products prepared by other processes, reference is made to FIGS. 6, 6A and 7 and the below table.

Figure 6:
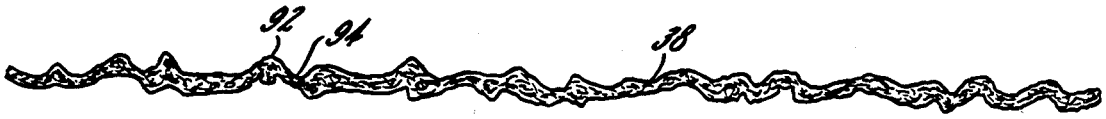
FIG. 6 is a drawing, highly idealized, illustrating in cross section single ply low basis weight fine creped tissue as conventionally manufactured.
Figure 6A:
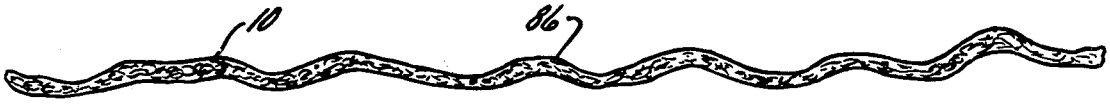
FIG. 6A is a drawing, highly idealized, illustrating in cross section single ply higher basis weight creped tissue as conventionally manufactured.

Referring to FIG. 6A the product here illustrated is water laid, lightly pressed, single ply heavy basis weight creped tissue, FIG. 6A being idealized to illustrate among other things the comparison to low basis weight creped tissue as drawn in FIG. 6. FIG. 6A reveals a dense, coarsely creped material, the crepe being somewhat irregular with peaks on one surface reflected in valleys on the other surface. This illustrates one case where the crepe is the same in both frequency and phase on both surfaces of the product; i.e., one surface is a reflection of the other. In this case of a heavy basis weight (15 lb. DBW) creped product, the surface against the creping drum (the lower surface of the web as shown was against the drum during creping), has relatively fine cracks or fissures as well as relatively sharp peaks, while the outer surface which was away from the drum has relatively smooth curved peaks. This characteristic of the outer surface is the result of the buckling of the web as it shortens to accommodate the degree of crepe introduced on the drum side of the material.

In single ply low basis weight creped tissue (FIG. 6; <10 lb. DBW), finer crepe may be obtained than in heavier basis weight material, since the transferrence is more complete so that a fine crepe is produced on both surfaces, as contrasted with the coarser more irregular outer surface which is the result of web buckling in a higher basis weight web. Even though the web shown in FIG. 6A was lightly pressed, the overall bulk of the web is relatively low as compared with the product of FIG. 7, for example, a product according to this invention. When the web shown in FIG. 6A is compared with a machine glazed web of comparable basis weight from a water laid unpressed fiber formation (the lack of pressing tending to enhance bulk), it is quite clear that creping has produced greater bulk.

The dramatically greater bulk and significantly different surface characteristics and internal structure achieved with the present invention can be seen by comparing FIG. 7 with FIG. 6A. The dryer basis weights of the products shown in these figures are comparable (about 15 lbs./2880 sq. ft.). FIG. 6A shows a single creped, unpressed water laid, heavy basis weight tissue, while FIG. 7 shows a double creped, unpressed, water laid, laminar heavy basis weight tissue. FIG. 7 is an idealized drawing of product which was made on a tissue machine having, in general, the configuration of the machine in FIG. 1, and after the first creping operation was creped off-line on equipment like that shown in FIG. 2. The product is shown in FIG. 7 after removal from the second creping drum and before stretching and calendering. The lower surface in FIG. 7 was against the creping drum during the second creping operation, and that surface has a fine crepe which is fairly regular in frequency, and the envelope defined by the peaks of the crepe is almost flat. On the top surface, which was the outer surface of the material during the second creping operation, the fine crepe which was produced during the first creping operation is superimposed upon a coarse crepe which is caused by a buckling of the web during the second creping operation. The envelope defined by peaks of the fine crepe is wavy. As above mentioned, the product drawn in FIG. 7 has not been subjected to conventional finishing operations in which it is stretched and calendered, to produce a smooth, ironed final product with uniform caliper. Such finishing operations will tend to flatten out the coarse surface irregularities present particularly on the upper surface of the product illustrated in FIG. 7, and also will tend to flatten out to some extent the fine crepe present on both surfaces.

In addition to having distinctive surface characteristics, product constructed according to this invention also has distinctive internal characteristics as compared with conventional creped tissue product; namely, the product has been opened internally in the Z-direction. As compared with FIG. 6A, which illustrates a product which after creping is still essentially a flat material with corrugations, the laminar product of this invention is a three dimensional material with significant thickness. This is believed to result from the development of a shear plane in the center of the material where the fibers are weakly bonded, and from the layer of fibers in the surface adjacent the creping drum being caused to buckle and gather and separate along the shear plane from the layer of fibers adjacent the outer surface of the material. In FIG. 7 it will be observed that the center of the web appears to have large voids and the fibers are separated, while in the layers adjacent both surfaces the fibers are entangled and in close engagement with one another.

While the product of this invention appears on visual inspection to be a single ply bulky creped product, the product can be readily delaminated manually with tweezers and the manual operation can be carried out and the shear plane seen with the aid of a microscope. Another, relatively crude, test for the laminar construction entails adhering a short piece (1"–2") of ordinary cellophane tape on one surface of the material and then stripping the surface layer of material from the base of the formation by means of the tape. Material well formed and bonded according to this invention will delaminate evenly along the central plane of the material under this "cellophane tape" test. In short, the product of this invention simulates a two ply tissue while having been formed as a single ply.

The following table and subsequent description details physical characteristics of and the process of manufacture of various examples of tissue webs:

TABLE

| Example | MD Strength* | % Stretch | CD Strength* | % Stretch | 10 Ply Bulk*** | Finished Basis Weight** | Bulk Density**** |
|---|---|---|---|---|---|---|---|
| I | 1376 | 18.8 | 626 | 3.9 | .090" | 18.67 | 2.27 |
| II | 4434+ | 1.0 | 1596 | 1.4 | .057" | 16.00 | 3.07 |
| III | 1006 | 21.8 | 475 | 7.6 | .137" | 19.60 | 1.57 |
| IV | 892 | 37.2 | 633 | 7.2 | .130" | 24.50 | 2.06 |

*Grams/3 Inch Width
**Pounds per 2880 Ft.$^2$
***The 10 ply bulk is read on an Ames bulk tester under a load of 11.3 gms./in$^2$.
****Bulk density was calculated in gms./in$^3$ for all examples expressing the density of the product in grams per cubic inch under a load of 11.3 gms./in$^2$. This density is calculated from the Ames bulk reading and basis weight as shown below:

$$\frac{\text{Basis Weight-lbs.}}{2880\ \text{ft}^2} \times \frac{453.6\ \text{gms.}}{1\ \text{lb.}} \times \frac{1\ \text{ft}^2}{144\ \text{in}^2} \times \frac{10\ \text{sheets}}{\text{Ames Bulk-in.}} = \frac{\text{B.W.} \times .01094}{10\ \text{ply Ames Rdg.}}$$

+ Tensile tester operated at 2"/min. crosshead speed rather than 20"/min. normally used for creped products because of very low stretch in MG sheet.

EXAMPLE I

The web example I was formed on a rolling slice forming section (see FIGS. 4, 5) at a speed of 1920 fpm. The furnish used consisted of 18.75% southern hardwood kraft, 18.75% northern softwood sulfite, 37.5% secondary fiber (consisting primarily of southern pine kraft and southern hardwood kraft) 25% broke and 0.25% Quaker 2001 chemical debonder. The wet sheet which was formed between a wire and a felt was subsequently pressed with a felt onto a creping dryer at a pressure of 80 pli. The web was then dried to approximately 5% moisture and creped off of the creping dryer. This example is meant to simulate a commercially producible debonded, lightly pressed creped tissue web of nominally 15 lb. dryer basis weight (DBW). The resulting creped tissue had the physical properties shown for the example I in the above table and was fairly dense and "papery", as would be expected from a product of this basis weight produced on a conventional creped wadding machine.

EXAMPLE II

A 15.0 lb. DBW paper web was manufactured on a paper machine like that shown in FIG. 1 from a furnish consisting of 50% NB50 northern softwood kraft, 25%

SP25 northern softwood sulfite and 25% CR57 southern hardwood kraft, 0.25% Mistron talc, 0.5% Kymene wet strength resin, and 0.35% Arquad 2HT debonder. The furnish was pulped 10 minutes at 6% consistency and formed into a paper web at 45 fpm. The formed web at about 20% consistency was transferred to a 40-mesh polyester fabric using a vacuum box. Additional vacuum was applied to the web on the fabric to further dewater the web to about 28% consistency. The web and the fabric were then passed through a through air dryer where the web was further dried to about 75% consistency using hot air at 200° F. The still moist web was then pressed against a creping dryer with the fabric passing around a pressure roll at a nip loading of 150 pli. The web was dried and removed from the creping dryer as a machine-glazed (uncreped) sheet which had never been wet pressed.

The machine glazed base sheet was fairly soft but generally unsuitable for a sanitary tissue product. It had the physical properties shown for Example II in the above table.

EXAMPLE III

A 15.0 lb. DBW single-ply tissue web was formed at 83 fpm using a three-compartment inlet and headbox which allowed three separate layers of web to be formed simultaneously. The two outer layers consisted of the same furnish, which was relatively strong and well beaten and contained wet strength resin. The inner layer consisted of a very weak chemically debonded furnish. The two outer layers which were each about 4.0 lb. DBW consisted of 50% NB50 northern softwood kraft, 50% SP25 northern softwood sulfite and 0.5% Kymene wet strength resin. The pulp was beaten for 60 minutes in a pulper at 6% consistency. The inner layer which had a 6.8 lb. DBW consisted of 50% secondary fiber, 50% CR57 southern hardwood kraft and 0.25% Arquad 2HT chemical debonder. This pulp was beaten for 15 minutes with the same conditions as the outer layer furnish. The formed three layer sheet was dewatered on a Fourdrinier table, transferred to a 78-mesh polyester through drying fabric like that shown in FIG. 1, through dried to the 75% consistency level and pressed against a Yankee dryer with the fabric passing around a pressure roll loaded at about 180 pli. The web was then dried on the Yankee dryer and creped. A minor amount of adhesive consisting of polyvinyl alcohol, Crepetrol and additives was sprayed on the Yankee dryer to control web adhesion and creping.

This tissue web which had never been pressed in a wet state was turned over and pressed to a creping dryer with a smooth pressure roll at 150 pli and then dried and creped. A small amount of polyvinyl alcohol adhesive was sprayed on the dryer to control sheet sticking and creping as previously discussed. The resulting twice-creped product before final stretching and calendering for caliper control was soft and smooth, well suited for final processing as a facial tissue. It had the physical characteristics given for example III in the above table.

EXAMPLE IV

A tissue web was produced using the same furnish and inlet as described for example III. Example IV is intended to simulate the web resulting from use of a multiple inlet on a conventional single felt creped wadding machine to form a laminar product directly. The tissue web was produced at 46 fpm but was wet pressed between a felt and a creping dryer at about 180 pli rather than being through dried. The wet pressed sheet adhering to the creping dryer was dried and creped, then turned over and recreped in a manner identical to that of Example III. The resulting twice-creped sheet had the physical properties given in the table for Example IV. The product was very smooth and soft and well suited for final processing as a facial tissue.

We claim as our invention:

1. A process for the manufacture of creped tissue suitable for sanitary products such as facial and bathroom tissue, from papermaking fibers suspended in aqueous stock, said process comprising:

forming a web by simultaneously flowing three layers of stock onto a wire and extracting free water from the web, the two outer layers being of similar stock of fibers which form strong interfiber bonds, and the intermediate layer being of stock of fibers which form weak interfiber bonds in the laminar web as formed from said stocks to provide a laminar web with discrete outer layers separated by said intermediate layer, carrying the laminar web from the forming wire on a fabric to a first creping roll and transferring the laminar web to said roll, creping the laminar web from the first creping roll, adhering said laminar web to a second creping roll with the layer of strongly bonded fibers which was away from the first creping roll against said second creping roll, and creping the web from said second creping roll while so controlling the adhesion of the web to said second creping roll during creping that the layer of strongly bonded fibers against said second creping roll partially shears away from the other outer layer of strongly bonded fibers along the plane of the intermediate layer and is reformed into a fine, irregularly creped structure to enhance bulk and provide a soft fine creped surface.

2. A process according to claim 1 including the further step of taking said creped web from said second creping roll and adhering it to a third creping roll with the layer of strongly bonded fibers which was away from the second creping roll against the third creping roll, and creping the web from the third creping roll while so controlling the adhesion of the web to said third creping roll during creping that the layer of fibers against the roll partially shears away from the other layer of strongly bonded fibers along the plane of the intermediate layer and is reformed into a fine creped structure.

3. A process according to claim 1 wherein the web is creped from the first creping roll at a consistency of between about 60%–85% in a wet creping operation, and is creped from the second creping roll at a consistency above about 86% in a dry creping operation.

4. A process according to claim 2 wherein the web is creped from the first creping roll at a consistency of between about 60%–85% in a wet creping operation, and is creped from the second and third creping rolls at a consistency above about 86% in a dry creping operation.

5. A process according to claim 1 wherein the web is creped from all said creping rolls at a consistency of above about 86% in a dry creping operation.

6. A process according to claim 2 wherein the web is creped from all said creping rolls at a consistency of above about 86% in a dry creping operation.

7. A process according to claim 1 wherein adhesive is applied to both surfaces of the web prior to creping for crepe control.

8. A process for the manufacture of creped tissue from aqueous stock of papermaking fibers, said creped tissue being suitable for sanitary products such as facial and bathroom tissue, comprising:

forming a fibrous web of a basis weight between about 10 and 40 lbs/2880 square feet by simultaneously flowing multiple layers of stock onto a forming wire so as to provide a laminar construction having two outer layers separated by intermediate layers and wherein both outer layers of fibers extending less than half the web thickness have interfiber bonds which are distributed uniformly overall throughout the outer layers and are stronger than the interfiber bonds throughout the intermediate section of the web between said outer layers, the outer layers of said stock having been treated so that the fibers of said stock are bonded by natural interfiber bonds, and an intermediate layer of said stock having been treated to minimize interfiber bonding, in the laminar fibrous web formed from said stock, and creping the web twice by carrying out two creping operations, inverting the web between said creping operations so as to crepe both said outer layers while so controlling the adhesion of the web to a first creping roll in the first creping operation and to a second creping roll in the second creping operation as to provide discrete, independently, finely, irregularly, creped outer layers and partially shear each said discrete outer layer away from the other outer layer of the web along the plane of said intermediate section of the web and reform the web into a fine creped structure on both surfaces to enhance bulk and provide soft, fine, irregularly creped surfaces.

9. A process for the manufacture of creped tissue according to claim 8 wherein said fibrous web having a laminar construction is formed by simultaneously flowing three layers of stock onto a forming wire.

10. A process for the manufacture of creped tissue suitable for sanitary products such as facial and bathroom tissue, comprising:

forming a fibrous web by simultaneously flowing three layers of stock onto a forming wire, the two outer layers being of similar stock containing fibers which form strong interfiber bonds, and the intermediate layer of stock containing fibers which form weak interfiber bonds, in the fibrous web formed from said stock, to provide a laminar web with discrete outer layers having stronger interfiber bonds than in the central section intermediate said outer layer, creping said web twice, first with one surface against a creping roll and next with the other surface against a second creping roll, while so controlling the adhesion of the web to each creping roll during creping that the outer layer against the creping roll partially shears away from the other outer layer during creping, and provides a fine, irregular surface crepe.

11. A three layer tissue of papermaking fibers made by simultaneous formation from 3 layers of fiber stock creped on both surfaces having a dryer basis weight of between about ten and about forty lbs./2880 sq. ft. and suitable for sanitary tissue products, said tissue having a laminar construction of discrete finely creped outer surface layers of fibers partially sheared away from each other along a plane through the central section layer of fibers intermediate said outer surface layers, the fibers of said outer surface layers being bonded uniformly to each other overall with stronger interfiber bonds than between the fibers in said central section of said tissue, said stronger interfiber bonds in said outer surface layers being distributed substantially equally in every unit area thereof, the crepe in each outer layer being a fine, irregular crepe and the interfiber bonds between the fibers in said outer surface layers and in said central layer of said tissue including said shear plane consisting essentially of natural interfiber bonds with the interfiber bonds in said central layer being weaker than said stronger interfiber bonds in said outer surface layers.

* * * * *